US006099250A

United States Patent [19]

Ko

[11] Patent Number: 6,099,250

[45] Date of Patent: Aug. 8, 2000

[54] COOLING FAN MOUNTING ARRANGEMENT

[75] Inventor: Ching-Rong Ko, Hsinchu, Taiwan

[73] Assignee: D-Link Corporation, Hsinchu, Taiwan

[21] Appl. No.: 09/362,072

[22] Filed: Jul. 28, 1999

[51] Int. Cl.[7] ..... F01D 25/28; F03D 11/04; F04D 29/60

[52] U.S. Cl. ..... 415/213.1; 415/220; 361/695; 361/692

[58] Field of Search ..... 415/213.1, 220, 415/214.1, 223; 361/687, 695, 692; 454/184; 257/706, 727; 165/121, 122

[56] References Cited

U.S. PATENT DOCUMENTS

| | | | |
|---|---|---|---|
| 4,353,680 | 10/1982 | Hiraoka et al. | 415/219 R |
| 4,774,911 | 10/1988 | Yamaguchi et al. | 123/41.49 |
| 4,834,615 | 5/1989 | Mauch et al. | 415/213.1 |
| 5,015,900 | 5/1991 | Morrill | 310/91 |
| 5,562,407 | 10/1996 | Cielo | 415/121.2 |

FOREIGN PATENT DOCUMENTS 0022928 1/1987 Japan .

*Primary Examiner*—Edward K. Look
*Assistant Examiner*—Rhonda Barton
*Attorney, Agent, or Firm*—Bacon & Thomas, PLLC

[57] ABSTRACT

A cooling fan mounting arrangement, which includes a network apparatus, the network apparatus having an upright side wall, one set of air vents at the upright side wall, and one pair of positioning means for example screw rods spaced from the upright side wall at a distance, and a cooling fan fastened to the screw rods and spaced from the upright side wall at a distance and aimed at the air vents at the upright side wall, the cooling fan has two mounting frames formed on the periphery thereof and outwardly diagonally extended in reversed directions at same elevation, the mounting frames each having a positioning means, for example, a through hole respectively coupled to the screw rods at the network apparatus and locked by a respective locking member, for example, a lock nut.

3 Claims, 4 Drawing Sheets

COOLING FAN MOUNTING ARRANGEMENT

BACKGROUND OF THE INVENTION

A network apparatus or the so-called embedded system (for example, a hub) is generally equipped with a cooling fan for quick dissipation of heat from its internal integrated circuit means. As illustrated in FIGS. 1 and 2, the cooling fan comprises a casing 90, and a fan blade assembly 91 pivotably mounted within the casing 90. The casing 90 has mounting holes at the corners thereof respectively and fixedly fastened to one upright side wall of the shell of the network apparatus 80 by screw bolts 71 and nuts 72. The upright side wall of the shell of the network apparatus 80 has air vents 81 corresponding to the fan blade assembly 91 in the casing 90 of the cooling fan. This cooling fan mounting arrangement has following drawbacks:

1. Because the fan casing 90 has a rectangular profile closely attached to the upright side wall of the shell of the network apparatus 80, the air vents 81 are made having a narrow, smoothly arched shape so as to prevent external object from being sucked into the inside of the fan casing 90. However, this design causes a high noise to be produced during the operation of the cooling fan. During the rotary motion of the fan blade assembly of the cooling fan, a part of outgoing currents of air or incoming currents of air is forced by the blocking area around the air vents 81 to flow back into the inside of the fan casing 90, thereby causing a negative pressure to be produced. Because of the presence of a negative pressure during the operation of the cooling fan, a turbulent flow of air is produced inside the fan casing 90, inducing a high noise.

2. Because the fan casing 90 is fastened to the upright side wall of the shell of the network apparatus 80 by screw bolts 71 and nuts 72, the screw bolts 71 receive much torsional force during the operation of the cooling fan, and the border area around each mounting hole at the fan casing 90 tends to be deformed.

SUMMARY OF THE INVENTION

The present invention provides a cooling fan mounting arrangement, which eliminates the aforesaid drawbacks. According to one aspect of the present invention, the cooling fan comprises two mounting frames formed on the periphery thereof and outwardly diagonally extended in reversed directions at same elevation, the mounting frames each having a positioning means, for example, a through hole respectively coupled to a respective positioning means, for example, a screw rod at the network apparatus and locked by a respective locking member, for example, a lock nut. After installation, the cooling fan is aimed at corresponding air vents at an upright side wall of the network apparatus, and spaced from the upright side wall of the network apparatus at a distance to prevent the occurrence of a negative pressure during its operation. According to another aspect of the present invention, the mounting frames are diagonally extended in reversed directions from the peripheral wall of the fan casing of the cooling fan. This mounting frame design enables two cooling fans to be closely arranged in a line to minimize space occupation when installed in a network apparatus.

DETAILED DESCRIPTION OF THE PREFERRED EMBODIMENT

Figure 1:
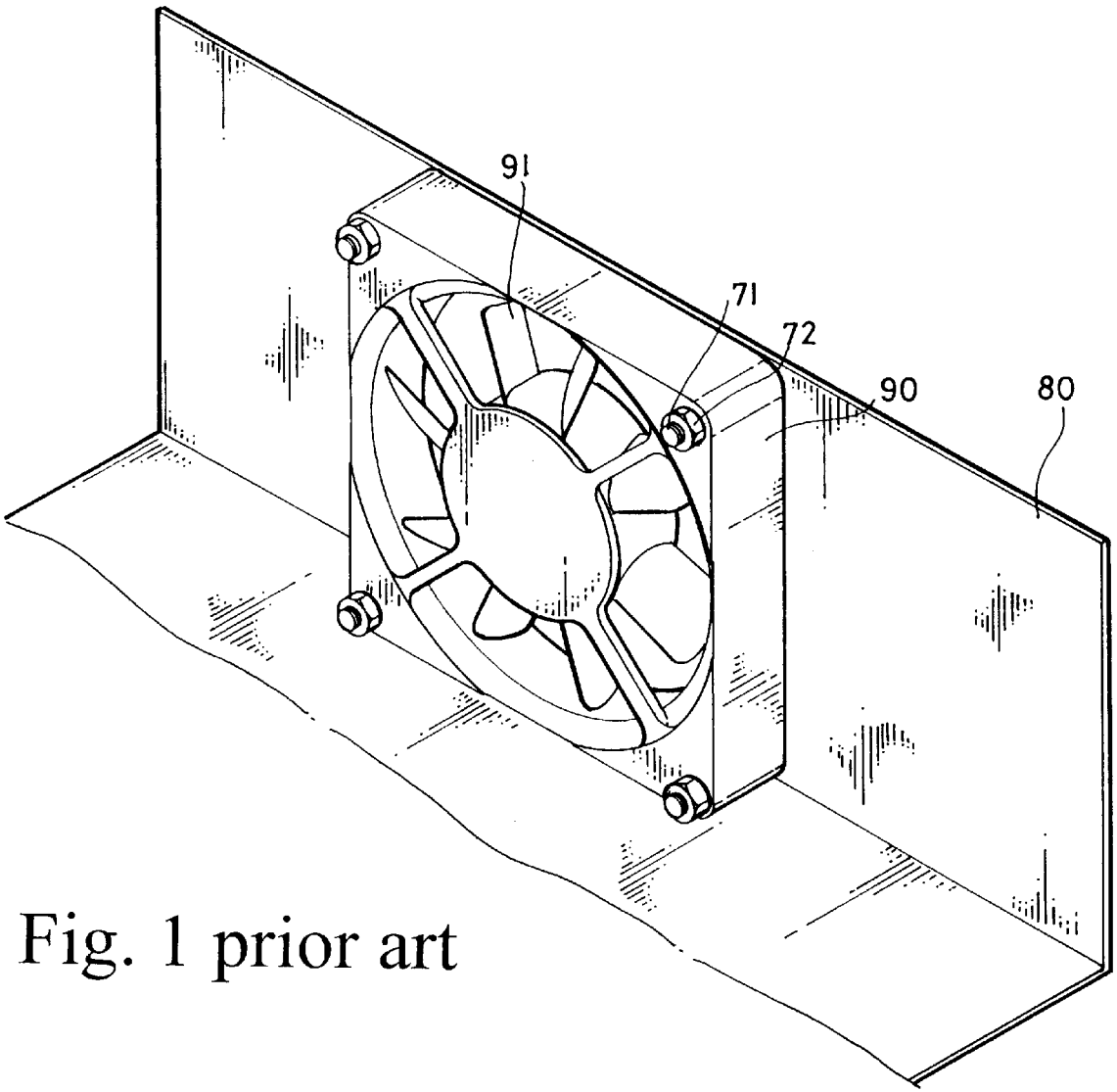
Fig. 1 prior art
FIG. 1 illustrates a cooling fan installed in the shell of a network apparatus according to the prior art.
Figure 2:
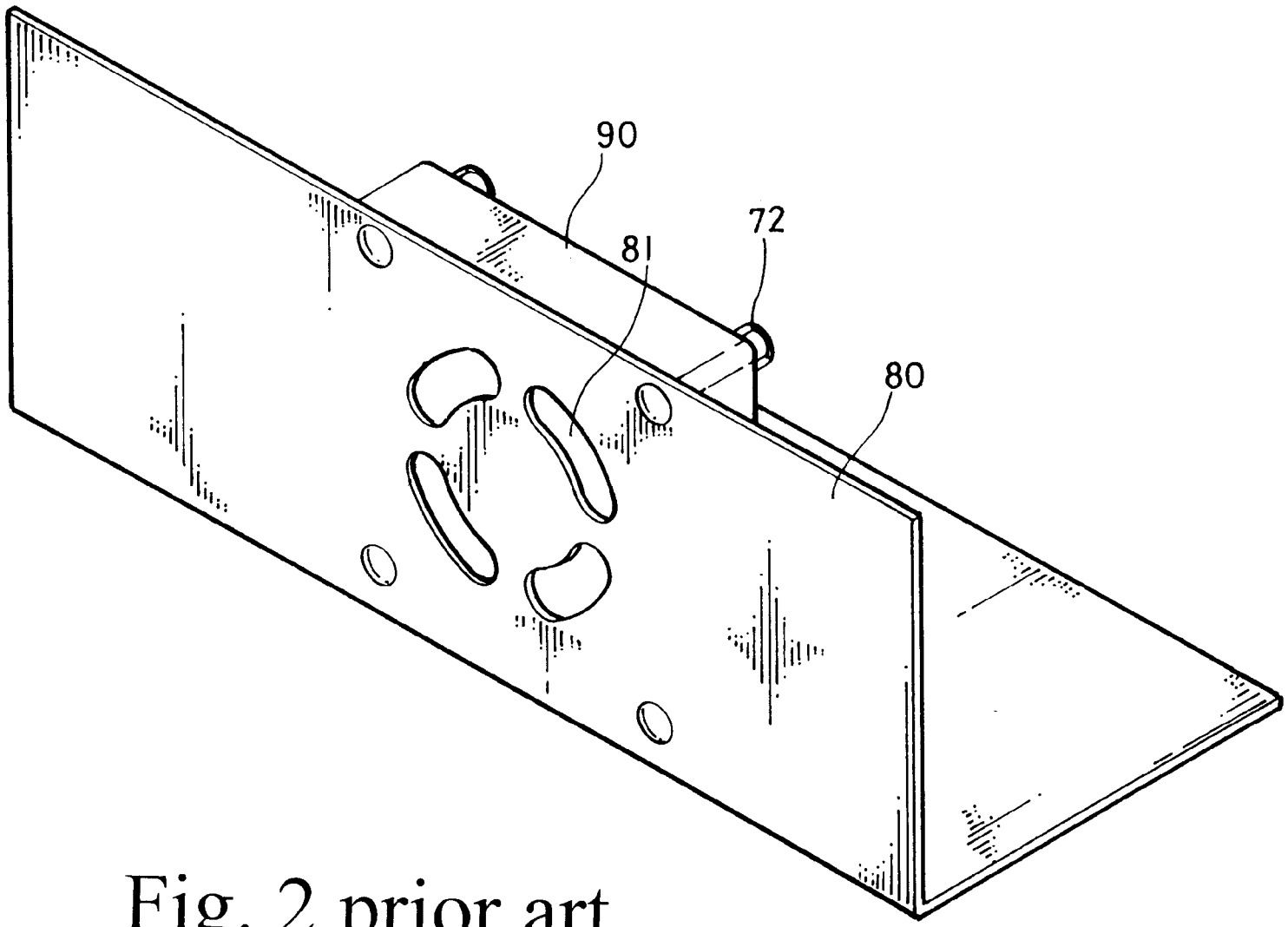
Fig. 2 prior art
FIG. 2 is an oblique back side view of FIG. 1.
Figure 3:
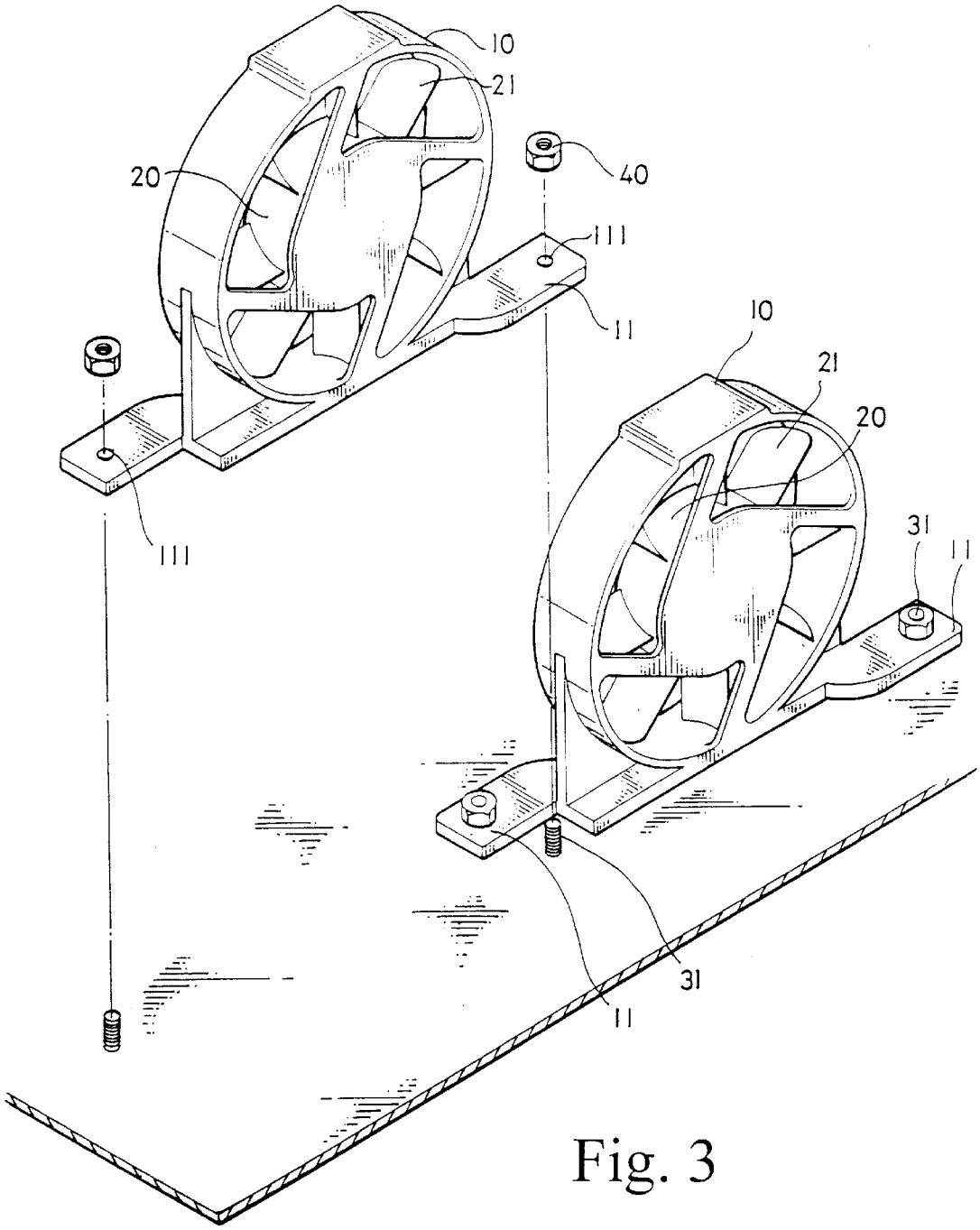
FIG. 3 is an exploded view of the present invention.

Referring to FIG. 3, a cooling fan is shown comprised of a hollow, circular fan casing 10, a hub 20 revolvably supported on the inside of the fan casing 10 at the center, and a plurality of radial fan blades 21 formed in integrity with the hub 20 and obliquely equiangularly spaced around the periphery of the hub 20. The fan casing 10 comprises two mounting frames 11 formed on the periphery thereof and outwardly diagonally extended in reversed directions at same elevation. According to the present preferred embodiment, the mounting frames 11 are flat plates formed integral with the peripheral wall of the fan casing 10, and longitudinally aligned. The mounting frames 11 each have a positioning means, for example, a through hole 111 for coupling to a respective positioning means, for example, a screw rod 31 at the network apparatus 30.

Figure 4:
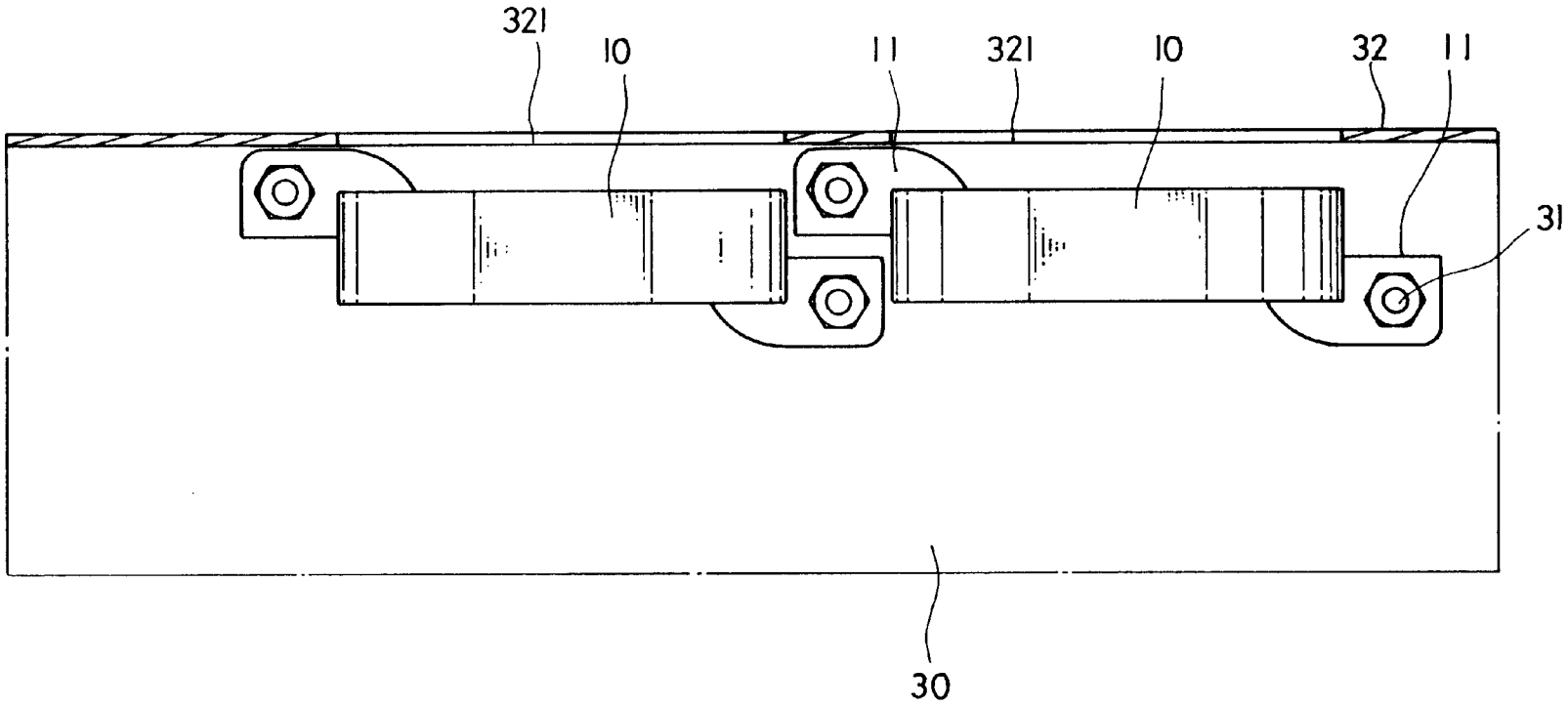
FIG. 4 is a top view of the present invention showing the cooling fan installed.

Referring to FIG. 4 and FIG. 3 again, the cooling fan is fastened to the network apparatus 30 by: coupling the through hole 111 at each of the mounting frames 11 to the respective screw rods 31 at the network apparatus 30, then threading a respective locking means, for example, a lock nut 40 onto each of the screw rods 31 to fixedly secure the mounting frames 11 of the cooling fan to the network apparatus 30. After installation of the cooling fan in the network apparatus 30, the fan casing 10 of the cooling fan is spaced from the upright side wall 32 of the shell of the network apparatus 30 at a distance, and aimed at a corresponding set of air vents 321 at the upright side wall 32 of the shell of the network apparatus 30. Because the fan casing 10 is not closely attached to the upright side wall 32 of the shell of the network apparatus 30, no negative pressure is produced in the fan casing 10 during the operation of the cooling fan, i.e., less noise is produced during the operation of the cooling fan. Furthermore, because the two mounting frames 11 of the cooling fan are outwardly diagonally extended in reversed directions from the peripheral wall of the fan casing 10 and disposed at same elevation, less installation space is needed when two cooling fans are installed in the network apparatus 30 and arranged in a line (see FIG. 4). As indicated, when two cooling fans are installed in the network apparatus 30, the adjacent mounting frames 11 of the two network apparatus 30 are arranged in parallel to minimize space occupation.

While only one embodiment of the present invention has been shown and described, it will be understood that various modifications and changes could be made thereunto without departing from the spirit and scope of the invention disclosed. For example, the positioning means at the network apparatus can be through holes, and the positioning means at the mounting frames of the cooling fan can be screw rods respectively coupled to the through holes at the network apparatus and locked by respective lock nuts.

What the invention claimed is:

1. A cooling fan mounting arrangement comprising a network apparatus, said network apparatus having an upright side wall and one set of air vents at said upright side wall, and a cooling fan installed in said network apparatus and aimed at said air vents, wherein said network apparatus comprises one pair of positioning means spaced from said upright side wall at a distance for holding said cooling fan at a distance from said upright side wall; said cooling fan comprises two mounting frames formed on the periphery thereof and outwardly diagonally extended in reversed directions at the same elevation, said mounting frames each comprising a positioning means respectively coupled to the positioning means at said network apparatus and locked by a respective locking member.

2. The cooling fan mounting arrangement of claim 1 wherein the positioning means at said network apparatus are screw rods, and the positioning means at said mounting frames of said cooling fan are through holes respectively coupled to the screw rods at said network apparatus.

3. The cooling fan mounting arrangement of claim 1 wherein the positioning means at said network apparatus are through holes, and the positioning means at said mounting frames of said cooling fan are screw rods respectively coupled to the through holes at said network apparatus.

* * * * *